United States Patent [19]

Allam et al.

[11] Patent Number: 4,535,594

[45] Date of Patent: Aug. 20, 1985

[54] METHOD AND APPARATUS FOR GENERATING POWER AND LOW PRESSURE SATURATED OR NEAR SATURATED STEAM

[75] Inventors: Rodney J. Allam, Guildford; Alan L. Prentice, Surbiton, both of England

[73] Assignee: Air Products and Chemicals, Inc., Allentown, Pa.

[21] Appl. No.: 601,882

[22] Filed: Apr. 19, 1984

[30] Foreign Application Priority Data

Apr. 19, 1983 [EP] European Pat. Off. ..... 83302191.8

[51] Int. Cl.[3] ..... F01K 7/38; F01K 19/10

[52] U.S. Cl. ..... 60/654; 60/691

[58] Field of Search ..... 60/654, 670, 678, 688, 60/689, 691

[56] References Cited

U.S. PATENT DOCUMENTS 3,216,199 11/1965 Shaw et al. ..... 60/670

*Primary Examiner*—Allen M. Ostrager

*Attorney, Agent, or Firm*—James C. Simmons; E. Eugene Innis

[57] ABSTRACT

Low pressure steam leaving a turbine (108) is used to preheat a major part of the feed water to a boiler (107) to a higher temperature than the balance of the feed water. The preheated part of the feed water is then introduced into the boiler (107) at a higher temperature zone than the remainder of the feed water.

13 Claims, 5 Drawing Figures

METHOD AND APPARATUS FOR GENERATING POWER AND LOW PRESSURE SATURATED OR NEAR SATURATED STEAM

This invention relates to a method and apparatus for generating power and low pressure saturated or near saturated steam.

Certain industries require both saturated low pressure steam and electrical and/or mechanical power. In such industries it is conventional to attempt to satisfy both requirements by producing superheated steam in a gas, oil or coal fired boiler, expanding the superheated steam through a back pressure turbine to provide electrical and/or mechanical power, and desuperheating the low pressure steam leaving the turbine by the injection of boiler feed water. The recovery of energy from the turbine is thermally very efficient.

Quite frequently the required electrical and/or mechanical power required exceeds that which is available when the low pressure steam requirement is met. There are three conventional methods of dealing with this problem, viz:

1. Purchase electricity from an external supplier.
2. Add a gas turbine as a separate piece of equipment to generate the required power.
3. Add a condensing section to the existing back pressure turbine.

Each of the above methods has certain disadvantages, for example:

1. Purchasing electricity is relatively expensive;
2. Gas turbines will operate only on high quality fuel; and
3. Power generation by the condensing steam section is relatively inefficient (20–30% efficiency).

DE-B No. 1,088,987 suggests using the low pressure steam leaving the turbine to heat the *entire* feed to the boiler. However, we are not aware of any commercial use of this idea since the benefits gained are minimal as is shown hereinafter.

In order to reduce at least some of the above disadvantages the present invention provides a method for generating power and low pressure saturated or near saturated steam, which method comprises the steps of:

(a) heating feed water in a boiler to produce superheated steam; and (b) expanding said superheated steam through a turbine to provide mechanical and/or electrical power and low pressure steam; characterized in that said method includes the steps of:

(c) using at least part of said low pressure steam to heat a major part of said feed water to a temperature higher than the remainder of said feed water; and (d) introducing the thus heated part of said feed water and the remainder of said feed water into said boiler at different temperature zones therein.

Preferably, said major part comprises, by volume, from 51% to 90% of the feed water, more preferably from 60% to 87% and advantageously from 65% to 75% thereof.

Preferably, the heated part of the feed water from step (c) is added to the remainder of the feed water once it has been heated to substantially the same temperature as the heated part of the feed water. This is not however essential and, for example the heated part of the feed water from step (c) could be superheated totally independently from the remaining feed water.

Normally, the low pressure steam leaving the turbine will be superheated. However, even if it is saturated at a temperature higher than the feed water part of the low pressure saturated steam leaving the steam turbine can usefully be condensed to heat the said heat the said part of the feed water.

In one embodiment of the invention the major part of the feed water is heated first by condensing low pressure steam and subsequently by heat exchange with low pressure superheated steam from said turbine.

In another embodiment of the invention (i) the major part of the feed water is heated by condensing low pressure steam (ii) part of the heated feed water is further heated by heat exchange with low pressure superheated steam from the turbine; and (iii) the further heated part of the feed water, the portion which has only been heated by condensing low pressure steam, and the balance of the original feed water are introduced into the boiler at different temperature zones therein.

In a further embodiment of the invention (i) the entire feed water is preheated by condensing part of the low pressure steam; (ii) the major part of the preheated stream is then further heated by heat exchange with low pressure superheated steam from said turbine; and (iii) the further heated part of the feed water and the balance of the feed water are introduced into the boiler at different temperature zones therein.

The present invention also provides an apparatus for generating power and low pressure saturated or near saturated steam which apparatus comprises:

(a) a boiler for heating feed water to produce superheated steam; and (b) a turbine through which, in use, superheated steam from said boiler can be expanded to provide mechanical and/or electrical power and low pressure steam; characterized in that said apparatus further comprises:

(c) a first heat exchanger arranged to receive, in use, low pressure steam from said turbine;

(d) means for conveying a major part of said feed water into said first heat exchanger;

(e) a line to convey heated feed water from said first heat exchanger to said boiler; and (f) means to introduce the remainder of said feed water into said boiler;

the arrangement being such that, in use, the heated feed water from the first heat exchanger enters said boiler at a higher temperature zone than the remainder of said feed water.

In one embodiment of the invention the apparatus includes a second heat exchanger arranged, in use, to preheat feed water en route to said first heat exchanger, and a line to convey, in use, part of the low pressure steam from said first heat exchanger to said second heat exchanger to preheat said feed water.

In another embodiment of the invention the apparatus includes a line to convey a first minor, portion of said feed water to said boiler, a second heat exchanger, a line to convey the balance of said feed water to said second heat exchanger, a line to convey part of said feed water from said second heat exchanger to said first heat exchanger, a line to convey hot feed water from said second heat exchanger to said boiler, and a line to convey the balance of the feed water leaving said second heat exchanger to said boiler.

In a further embodiment of the invention the apparatus includes a second heat exchanger, a line to convey the entire feed water to said second heat exchanger, a line to convey the major part of the feed water from said second heat exchanger to said first heat exchanger, a line to convey hot water from said first heat exchanger to said boiler, and a line for conveying the balance of said feed water leaving said second heat exchanger to said boiler.

Typically, the superheated steam entering the turbine will be between 20 bar A and 180 bar A and the low pressure steam leaving the turbine will be between 1.5 bar A and 75 bar A.

The low pressure steam product can be saturated or can be near saturated, i.e. up to 50° C. above its saturation temperature.

For a better understanding of the invention reference will now be made, by way of example, to the accompanying drawings, in which.

Figure 1:
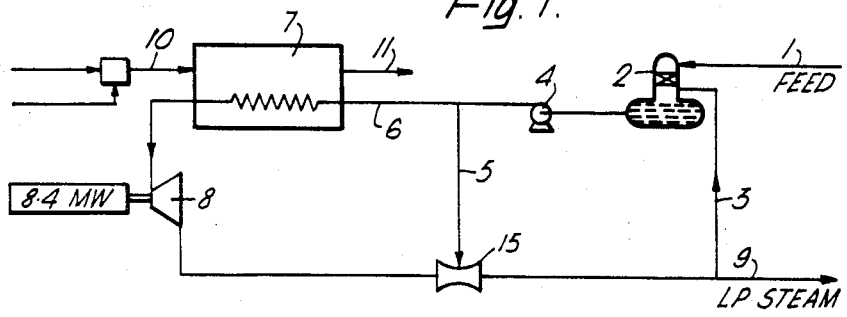
FIG. 1 is a simplified flow sheet of a known apparatus for generating power and low pressure steam.

Referring to FIG. 1, 100 t/h of feed water at 94° C. and 2.1 bar absolute (bar A) is introduced through line 1 into a de-aeration vessel 2 where it is heated to its boiling point (121° C.) by the injection of 5 t/h of saturated steam at 194° C. from line 3. The liquid leaving de-aeration vessel 2 is pumped to 62 bar A by pump 4. 10.6 t/h of the feed water is passed through line 5 and injected into superheated steam in direct de-superheater 15. The balance of the feed water (94.4 t/h) is passed through line 6 into boiler 7 which it leaves at 482° C. in the form of superheated steam.

The superheated steam is expanded to 13.8 bar A in turbine 8 which it leaves at 299° C. thereby producing 8.84 MW of mechanical power. The low pressure steam leaving the turbine 8 is then desuperheated by the injection of water from line 5. Part of the low pressure saturated steam is passed through line 3 whilst the balance (100 t/h at 13.8 bar A and 194° C.) is passed through process line 9.

The boiler 7 is heated by air and fuel (81.51 MW) which is introduced through line 10. The exhaust gas leaves the boiler 7 through line 11 at 170° C.

Figure 2:
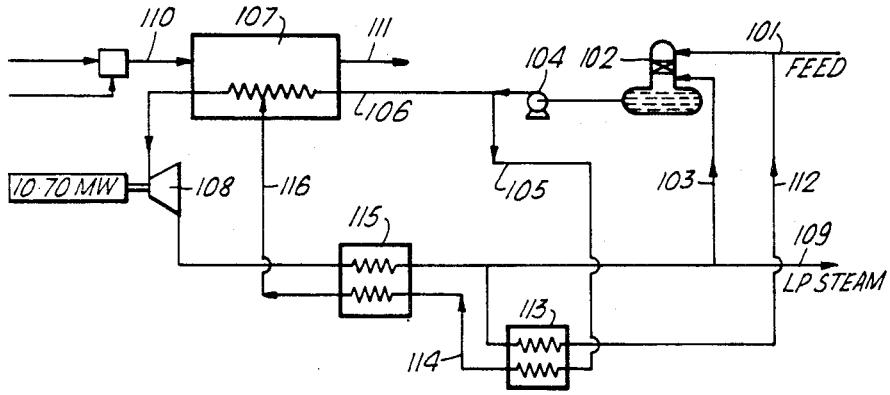
FIG. 2 is a simplified flow sheet of a first embodiment of apparatus for generating power and low pressure steam in accordance with the invention.

Referring now to FIG. 2, 100 t/h of feed water at 94° C. and 2.1 bar A, together with 10.8 t/h of hot water from line 112 is introduced through line 101 into a de-aeration vessel 102 where it is heated to its boiling point (121° C.) by the injection of 3.5 t/h saturated steam at 194° C. from line 103. The feed water leaving de-aeration vessel 102 is pumped to 62 bar A by pump 104.

32.6 t/h of the feed water is introduced into the boiler 107 through line 106. The major part of the feed water (81.7 t/h) is passed through line 105. It is then preheated in heat exchanger 113° to 186° C. and passed through line 114 to heat exchanger 115 where it is further heated to 260° C. The thus heated feed water is then passed through line 116 into the boiler 107 where it rejoins the water from line 106 at a temperature zone where it also has been heated to 260° C. The combined stream is then heated to 482° C. in the boiler 107 before being expanded through turbine 108 where it produced 10.70 MW of mechanical power. The low pressure steam leaves the turbine 108 superheated at 13.8 bar A and 299° C. It is then desuperheated, i.e. cooled to 194° C., in heat exchanger 115. Of the 114.3 t/h of saturated steam leaving heat exchanger 115, 3.5 t/h is injected into de-aeration vessel 102 through line 103 and 10.8 t/h is condensed in heat exchanger 114 and is returned to the de-aeration vessel 102 via line 112. 100 t/h of saturated steam at 13.8 bar A and 194° C. is passed to process line 109.

The boiler 107 is heated by air and fuel (83.5 MW) which is introduced through line 110. The exhaust gas leaves the boiler 107 through line 111 at 170° C.

Figure 3:
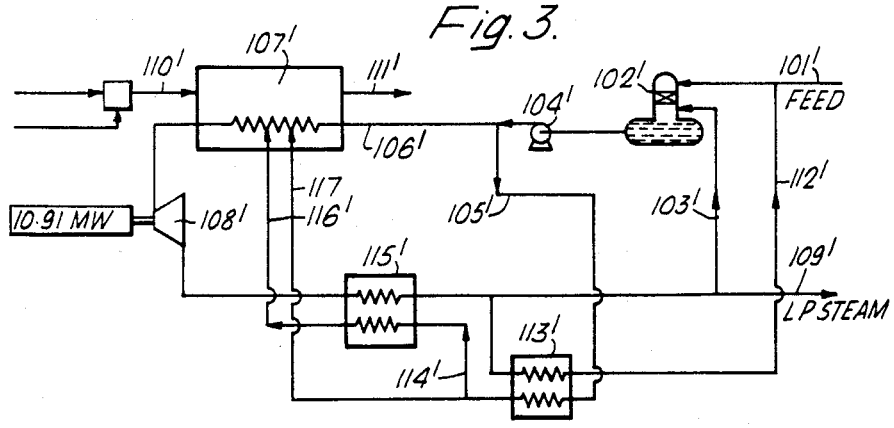
FIG. 3 is a simplified flow sheet of a second embodiment of apparatus for generating power and low pressure steam in accordance with the invention.

The apparatus shown in FIG. 3 is generally similar to that shown in FIG. 2 and parts having similar functions have been identified by the same reference numerals with the addition of a single apostrophe. The essential difference is that whilst in the embodiment shown in FIG. 2 the entire feed water passing through line 105 is heated in both heat exchangers 113 and 115, in the embodiment shown in FIG. 3 only part of an enlarged flow of feed water passing through line 105' is heated in both heat exchangers 113' and 115'.

In particular, of the 116.5 t/h of feed water leaving pump 104' at 62 bar A, 15 t/h enters the boiler 107' through line 106' whilst the balance (101.5 t/h) passes through line 105' to heat exchanger 113' where it is heated to 183° C. Part (83.3 t/h) of the heated feed water is passed through line 114' to the heat exchanger 115' where it is heated to 260° C. The hot feed water leaving heat exchanger 115' is passed through line 116' into the boiler 107'. The balance of the feed water (18.2 t/h) leaving heat exchanger 113' is passed through line 117 into the boiler 107'. The feed water passing through line 117 rejoins the feed water entering the boiler 107' through line 106' once it has been heated to 183° C. Similarly, hot feed water from line 116' joins the remaining water once it has been heated to 260° C. In this particular embodiment the turbine 108 develops 10.9 MW of mechanical power.

The boiler 107 is heated by air and fuel (83.73 MW).

Figure 4:
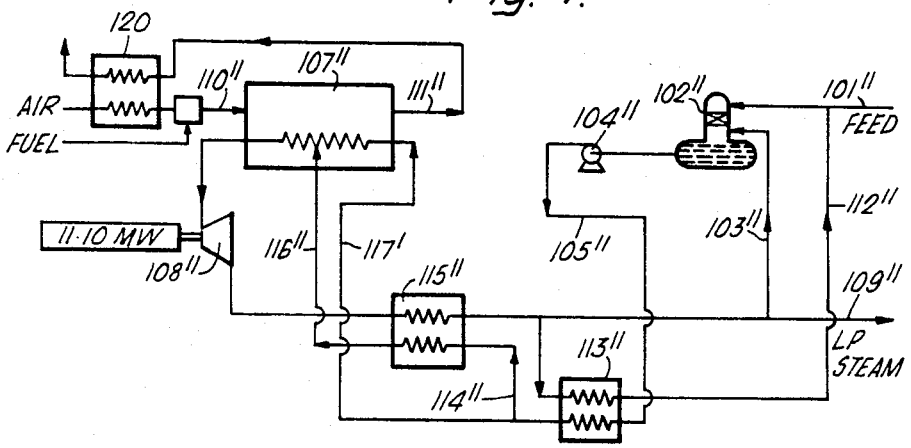
FIG. 4 is a simplified flow sheet of a third embodiment of apparatus for generating power and low pressure steam in accordance with the invention.

The embodiment shown in FIG. 4 is generally similar to that shown in FIG. 2 and parts having similar functions have been identified by the same reference numeral used in FIG. 3 with the addition of a second apostrophe. The essential difference is that line 106' has been omitted. The entire feed water, together with condensate from line 112'' and condensed steam from line 103'', compressed to 62 bar A by pump 104'' is cooled in heat exchanger 113''. The disadvantage of this embodiment is that the temperature of the exhaust gas 111'' must be higher than with the previous embodiments because of the higher initial temperature of the feed water. However, this disadvantage can be largely mitigated by using the exhaust gas to preheat the feed air in recuperator 120.

In particular, all the 118.5 t/h of feed water leaving pump 104'' at 62 bar A is heated to 194.3° C. in heat exchanger 113''. 33.8 t/h of the warmed feed water is passed through line 117'' direct to the boiler 107'' whilst the balance (84.7 t/h) is heated to 260° C. in heat exchanger 115'' before being introduced into the boiler 107'' through line 116''. As in all previous embodiments the superheated steam leaves the boiler 107'' at 482° C. and is expanded to 13.8 bar A in turbine 108'' which it leaves at 299° C. thereby producing 11.10 MW of mechanical power. The 118.5 t/h of superheated steam leaving turbine 108″ is passed through heat exchanger 115″. 15.7 t/h of the desuperheated steam leaving heat exchanger 115″ are condensed in heat exchanger 113″ and returned through line 112″ to join the feed water whilst 2.8 t/h are fed to de-aeration vessel 102″. 110 t/h of feed water enter the system through line 101 and 100 t/h of low pressure saturated steam leave the system through process line 109″.

The boiler 107″ is heated by air and fuel (83.92 MW).

Figure 5:
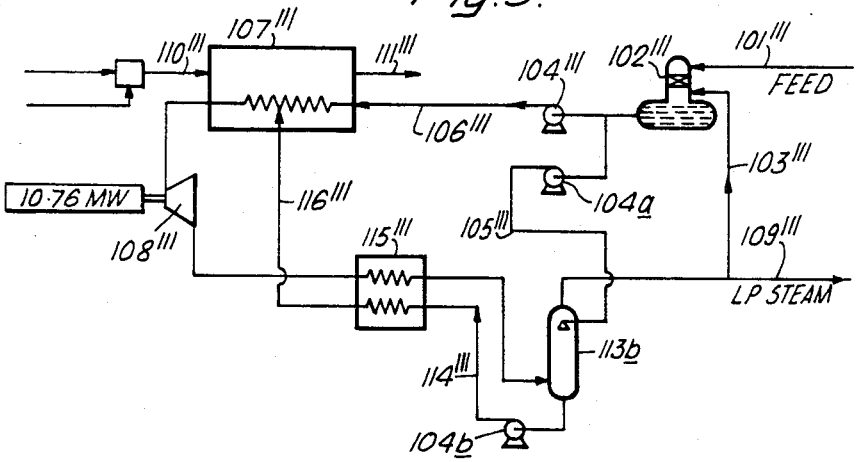
FIG. 5 is a simplified flow sheet of a fourth embodiment of apparatus for generating power at low pressure steam in accordance with the invention.

The embodiment shown in FIG. 5 is generally similar to that shown in FIG. 2 and parts having similar functions have been identified by the same reference numeral used in FIG. 2 with the addition of three apostrophies. The essential difference is that the indirect heat exchanger 113 has been replaced by a heat exchanger comprising a direct contact condenser 113*b*.

In particular, of the 105 t/h of feed water leaving de-aeration vessel 102‴, 33.2 t/h are pumped to 62 Bar A by pump 104‴ and passed through line 106‴ to boiler 107‴. The balance, 71.8 t/h is pumped to 13.8 bar A by pump 104*a* and passed through line 105‴ into direct contact condenser 113*b* where it is heated by the low pressure saturated steam. The liquid (81.7 t/h) is pumped to 62 bar A by pump 104*b* and passed through line 114‴ to heat exchanger 115‴ where it is heated to 263° C. before being passed through line 116‴ into boiler 107‴ where it is recombined with the feed from pump 104‴ which has also been heated to 263° C. in the boiler 107‴. The feed leaves the boiler 107‴ as superheated steam at 482° C. and 62 bar A. It is expanded through turbine 108 which it leaves at 299° C. thereby generating 10.76 MW of mechanical power.

The superheated steam is desuperheated in heat exchanger 115‴. 9.9 t/h of the low pressure saturated steam is condensed in direct contact condenser 113*b* and 5 t/h are passed through line 103‴ to the de-aeration vessel 102″7. As before 100 t/h of feed water enter the system through line 101‴ and 100 t/h of saturated low pressure steam leave through process line 109‴.

The boiler 107′ is heated by air and fuel (83.55 MW).

The disadvantage of this embodiment is the need for additional pumps.

Table 1 provides a quick comparison of the various apparatus described. It should be appreciated that the term "boiler" as used herein embraces any suitable heat source, e.g. a reformer convection section, as well as a conventional furnace.

It will be noted that in each of the embodiments described in FIGS. 2 to 5, the shaft power generated in the back pressure turbine is increased by increasing the amount of steams passing through the turbine at the same inlet and outlet temperature and pressure as previously used. This increase in power is obtained at very high efficiency—substantially the same efficiency as is obtained in the conversion of heat energy in the boiler fuel to heat energy in the high pressure, high temperature steam leaving the boiler.

If desired, it would, of course be possible to use the present invention to maintain a desired shaft power but deliver a lower quantity of desuperheated steam.

In many applications where more power is required than can be generated by a back-pressure steam turbine a condensing steam turbine is added to the system. Here, for a fixed amount of power and product low pressure steam the use of the present invention may increase the power generated by the back-pressure turbine and thus allow a reduction of the power of the condensing turbine and hence a reduction of the fuel consumption.

It will be noted that the feed water is heated whilst under pressure. This pressure should preferably be at least 4 bar A.

By way of comparison, Table 1 also includes an additional column comparing the output of a system as shown in FIG. 3 of DE-A No. 1,088,987. As can readily be seen, the Nett increase in power is small compared with the Nett increase in fuel.

TABLE 1

| FIG. | 1 | 2 | 3 | 4 | 5 | * |
|---|---|---|---|---|---|---|
| Nett Heat Ex System from LP Steam (MW) | 66.46 | 66.46 | 66.46 | 66.46 | 66.46 | 66.46 |
| Turbine Power (MW) | 8.84 | 10.70 | 10.91 | 11.10 | 10.76 | 9.83 |
| −Pumping Power (MW) | −0.31 | −0.34 | −0.34 | −0.35 | −0.35 | −0.31 |
| Nett Increase in power over FIG. 1 (MW) | 0 | 1.83 | 2.04 | 2.22 | 1.88 | 0.99 |
| Heat to Steam in boiler (MW) | 74.99 | 76.82 | 77.03 | 77.21 | 76.87 | 75.98 |
| Heat from fuel in boiler (MW) | 81.51 | 83.50 | 83.73 | 83.92 | 83.55 | 84.42 |
| Nett Increase in fuel over FIG. 1 (MW) | 0 | 1.99 | 2.22 | 2.41 | 2.04 | 2.91 |
| $\frac{\text{Net Increase in Power}}{\text{Net Increase in Fuel}}$ (%) | | 91.96 | 91.89 | 92.12 | 92.16 | 34 |

*Using system described in FIG. 3 of DE-B-1,088,987

What is claimed is:

1. A method for generating power and low pressure saturated or near saturated steam, which method comprises the steps of:

(a) heating feed water in a boiler to produce superheated steam; and (b) expanding said superheated steam through a turbine to provide mechanical and/or electrical power and low pressure steam;

characterized in that said method includes the steps of:

(c) using at least part of said low pressure steam to heat a major part of said feed water to a temperature higher than the remainder of said feed water; and (d) introducing the thus heated part of said feed water and the remainder of said feed water into said boiler at different temperature zones therein.

2. A method according to claim 1, wherein said major part comprises from 51% to 90% by volume of the feed water.

3. A method according to claim 2, wherein said major part comprises from 60% to 87% by volume of the feed water.

4. A method according to claim 3, wherein said major part comprises from 65% to 75% by volume of the feed water.

5. A method according to claim 1, wherein the heated part of the feed water from step (c) is added to the remainder of the feed water once it has been heated to substantially the same temperature as the heated part of the feed water.

6. A method according to claim 1, wherein the expanded steam leaving said turbine is superheated.

7. A method according to claim 6, wherein the major part of the feed water is heated first by condensing low pressure steam and subsequently by heat exchange with low pressure superheated steam from said turbine.

8. A method according to claim 7, (i) wherein the major part of the feed water is heated by condensing low pressure steam (ii) part of the heated feed water is further heated by heat exchange with low pressure superheated steam from the turbine; and (iii) the further heated part of the feed water, the portion which has only been heated by condensing low pressure steam, and the balance of the original feed water are introduced into the boiler at different temperature zones therein.

9. A method according to claim 7, (i) wherein the entire feed water is preheated by condensing part of the low pressure steam; (ii) the major part of the preheated stream is further heated by heat exchange with low pressure superheated steam from said turbine; and (iii) the further heated part of the feed water and the balance of the feed water are introduced into the boiler at different temperature zones therein.

10. An apparatus for generating power and low pressure saturated or near saturated steam which apparatus comprises:

(a) a boiler for heating feed water to produce superheated steam; and (b) a turbine through which, in use, superheated steam from said boiler can be expanded to provide mechanical and/or electrical power and low pressure steam;

characterized in that said apparatus further comprises:

(c) a first heat exchanger arranged to receive, in use, low pressure steam from said turbine;

(d) means for conveying a major part of said feed water into said first heat exchanger;

(e) a line to convey heated feed water from said first heat exchanger to said boiler; and (f) means to introduce the remainder of said feed water into said boiler;

the arrangement being such that, in use, the heated feed water from the first heat exchanger enters said boiler at a higher temperature zone than the remainder of said feed water.

11. An apparatus as claimed in claim 10, including a second heat exchanger arranged, in use, to preheat feed water en route to said first heat exchanger, and a line to convey, in use, part of the low pressure steam from said first heat exchanger to said second heat exchanger to preheat said feed water.

12. An apparatus as claimed in claim 10, including a line to carry a first minor, portion of said feed water to said boiler, a second heat exchanger, a line to convey the balance of said feed water to said second heat exchanger, a line to convey part of said feed water from said second heat exchanger to said first heat exchanger, a line to convey hot feed water from said second heat exchanger to said boiler, and a line to convey the balance of the feed water leaving said second heat exchanger to said boiler.

13. An apparatus as claimed in claim 10, including a second heat exchanger, a line to convey the entire feed water to said second heat exchanger, a line to convey the major part of the feed water from said second heat exchanger to said first heat exchanger, a line to convey hot water from said first heat exchanger to said boiler, and a line for conveying the balance of said feed water leaving said second heat exchanger to said boiler.

* * * * *